US010265738B2

(12) United States Patent
Damore

(10) Patent No.: US 10,265,738 B2
(45) Date of Patent: Apr. 23, 2019

(54) APPARATUS, SYSTEMS, AND METHODS FOR WASHING SANDY, DEBRIS-RIDDEN AND/OR SALINATED ARTICLES

(71) Applicant: Dean R. Damore, Brightwaters, NY (US)

(72) Inventor: Dean R. Damore, Brightwaters, NY (US)

( * ) Notice: Subject to any disclaimer, the term of this patent is extended or adjusted under 35 U.S.C. 154(b) by 138 days.

(21) Appl. No.: 15/267,665

(22) Filed: Sep. 16, 2016

(65) Prior Publication Data

US 2017/0080464 A1 Mar. 23, 2017

Related U.S. Application Data

(60) Provisional application No. 62/222,427, filed on Sep. 23, 2015.

(51) Int. Cl.
*B08B 3/04* (2006.01)
*B08B 3/14* (2006.01)
(Continued)

(52) U.S. Cl.
CPC ..... *B08B 3/048* (2013.01); *A47L 23/00* (2013.01); *B08B 3/14* (2013.01); *D06F 1/02* (2013.01);
(Continued)

(58) Field of Classification Search
CPC ..... B08B 3/048; B08B 3/06; B08B 3/045; B08B 3/047; D06F 1/00; D06F 1/10;
(Continued)

(56) References Cited

U.S. PATENT DOCUMENTS 2,697,341 A * 12/1954 Thomas ..... D06F 41/00 134/153
4,157,922 A * 6/1979 Luik ..... B08B 3/102 134/102.1
(Continued)

FOREIGN PATENT DOCUMENTS

DE 2558239 A1 * 6/1977 ..... B08B 3/02

OTHER PUBLICATIONS

DE2558239—Machine Translation (Year: 1977).*

*Primary Examiner* — Marc Lorenzi
(74) *Attorney, Agent, or Firm* — Carter, DeLuca & Farrell LLP

(57) ABSTRACT

An apparatus for washing an article includes a container defining an internal chamber configured to receive the article, an inflow connector connectable to a source of pressurized fluid, a filter member disposed within the internal chamber between a base of the container and the inflow connector, and a lid sealingly engagable with an open upper end of the container and defining at least one opening. Pressurized fluid supplied to the internal chamber is urged upwardly through the internal chamber, through and around an article disposed therein, and out the at least one opening of the lid. As a result, salt retained within or on the article is expelled through the at least one opening of the lid and particulate on or within the article is collected or passed through the filter member. Systems incorporating the apparatus and methods of using the same are also provided.

16 Claims, 13 Drawing Sheets

(51) Int. Cl.

| | |
|---|---|
| ***D06F 1/02*** | (2006.01) |
| ***D06F 1/10*** | (2006.01) |
| ***D06F 39/10*** | (2006.01) |
| ***A47L 23/00*** | (2006.01) |
| *D06F 17/00* | (2006.01) |
| *B63C 11/04* | (2006.01) |

(52) U.S. Cl.
CPC ..... *D06F 1/10* (2013.01); *D06F 39/10* (2013.01); *B63C 2011/046* (2013.01); *D06F 17/00* (2013.01)

(58) Field of Classification Search
CPC ..... D06F 1/02; H01L 21/67057; C23G 3/00; A47L 17/02
See application file for complete search history.

(56) References Cited

U.S. PATENT DOCUMENTS

| | | | | |
|---|---|---|---|---|
| 4,852,596 | A * | 8/1989 | Fry | B08B 3/04 134/182 |
| 5,028,273 | A * | 7/1991 | Weltmer, Jr. | B08B 3/10 134/42 |
| 6,523,552 | B2 * | 2/2003 | Pokorny | H01L 21/67017 134/182 |
| 2010/0193046 | A1 * | 8/2010 | Moroder | E04D 13/08 137/357 |
| 2012/0311811 | A1 * | 12/2012 | Hollis | A47L 7/0023 15/327.1 |
| 2014/0047986 | A1 * | 2/2014 | Robinson | A61M 1/0281 100/131 |

* cited by examiner

APPARATUS, SYSTEMS, AND METHODS FOR WASHING SANDY, DEBRIS-RIDDEN AND/OR SALINATED ARTICLES

CROSS-REFERENCE TO RELATED APPLICATIONS

This application claims the benefit of U.S. Provisional Patent Application No. 62/222,427 filed on Sep. 23, 2015, the entire contents of which are hereby incorporated herein by reference.

BACKGROUND

Technical Field

The present disclosure relates to apparatus, systems, and methods for washing sandy, debris-ridden, and/or salinated articles, e.g., wetsuits, bathing suits, beach towels, clothing, footwear, snorkels, masks, diving/scuba gear, etc.

Background of the Disclosure

The beach provides ample opportunity for fun, excitement, and/or relaxation. However, certain articles, particularly those used in and around the ocean, may become sandy, ridden with debris, and/or salinated from the saltwater. Such articles include, for example, wetsuits, bathing suits, beach towels, clothing, footwear, snorkels, masks, diving/scuba gear, etc. Sand and other beach debris can easily be trapped on or within these articles and, as a result, find their way into vehicles and homes. Salt from saltwater may also be absorbed and/or retained by these articles, and can have a corrosive and/or irritating effect if not sufficiently expelled. It is therefore desirable to remove such sand, debris, and salt from these articles after use for cleanliness purposes and to increase the longevity of the articles.

Wetsuits, for example, are commonly used in beach activities such as surfing. As can be appreciated, during use, sand, debris, and salt may become trapped on, within, and/or absorbed by the wetsuit. Simply rinsing the wetsuit is ineffective in sufficiently removing the sand, debris, and salt that may become trapped and/or absorbed therein.

Accordingly, there is a need for apparatus, systems, and methods that more efficiently and effectively remove sand, debris, and salt from wetsuits and other articles.

SUMMARY

The present disclosure provides apparatus, systems, and methods for washing an article, e.g., wetsuit, bathing suit, beach towel, clothing, footwear, snorkel, masks, diving/scuba gear, etc.

An apparatus for washing an article provided in accordance with aspects of the present disclosure includes a container, an inflow connector, a filter member, and a lid. The container includes a sidewall and a base cooperating to define an internal chamber configured to receive an article to be washed. The container further includes a closed lower end and an open upper end and defines an inflow opening through the sidewall thereof towards the closed lower end thereof. The inflow connector is sealingly engaged within the inflow opening of the sidewall of the container. The inflow connector is configured to connect to a source of pressurized fluid for supplying pressurized fluid to the internal chamber of the container. The filter member is disposed within the internal chamber of the container between the base of the container and the inflow opening of the container. The filter member is configured to collect particulate and/or permit passage of particulate therethrough. The lid is releasably sealingly engagable with the upper end of the container. The lid defines at least one opening therethrough. The apparatus is configured such that pressurized fluid supplied through the inflow connector and into the internal chamber of the container is urged upwardly through the internal chamber of the container, through and around an article disposed within the internal chamber of the container, and out the at least one opening of the lid, thereby carrying or urging salt retained within or on the article through the apertures of the lid. The apparatus is further configured such that particulate on or within the article is collected within the filter member and/or passed through the filter member to settle on the base of the container.

In an aspect of the present disclosure, the inflow connector includes a valve mechanism transitionable between an open configuration, permitting the inflow of fluid into the internal chamber of the container, and a closed configuration, inhibiting the inflow of fluid into the internal chamber of the container.

In another aspect of the present disclosure, the lid includes a plurality of snap-fingers configured for circumferential engagement about the open upper end of the container to releasably sealingly engage the lid about the upper end of the container. Alternatively, the lid may include at least one lock handle movable between an upward, unlocked position and a downward, locked position, to releasably sealingly engage the lid about the upper end of the container.

The container may be a bucket or a barrel.

In yet another aspect of the present disclosure, the filter member is formed from a flexible material and defines at least one groove configured to collect particulate and a plurality of apertures configured to permit passage of particulate therethrough.

In still another aspect of the present disclosure, the filter member is formed from a flexible material and defines a plurality of ridges and recesses. The recesses are configured to collect particulate.

In still yet another aspect of the present disclosure, the filter member is formed from a flexible material and includes a body defining a plurality of apertures configured to permit passage of particulate therethrough and an annular flange configured to support the body spaced-apart above the base of the container.

A system for washing an article provided in accordance with aspects of the present disclosure includes an inflow hose configured to connect to a source of pressurized fluid and an article washing apparatus, e.g., according to any of the aspects detailed above.

In an aspect of the present disclosure, the system further includes an outflow hose configured to receive expelled fluid and salt from the apparatus.

A method for washing an article provided in accordance with aspects of the present disclosure includes placing an article to be washed into an internal chamber of a container, sealingly engaging a lid including at least one opening about an open upper end of the container, and supplying pressurized fluid to the internal chamber of the container through an inflow opening in a sidewall of the container. As a result of supplying pressurized fluid, the internal chamber is filled with the pressurized fluid thereby pinning the article against an interior surface of the lid, the pressurized fluid is urged through and around the article and out of the internal chamber of the container via the at least one opening of the lid, the pressurized fluid carries or urges salt retained within or on the article through the plurality of apertures of the lid, and particulate on or within the article is collected within a filter member disposed towards a closed lower end of the container below the inflow opening and/or passed through at least one aperture defined within the filter member to settle at the closed lower end of the container.

In aspects, supplying the pressurized fluid includes opening a valve mechanism associated with the inflow opening.

In aspects, the filter member is positioned within the internal chamber of the container prior to placing the article to be washed into the internal chamber of the container.

In aspects, sealingly engaging the lid about the open upper end of the container includes engaging a plurality of snap-fingers of the lid circumferentially about the open upper end of the container or moving at least one lock handle of the lid from an upward, unlocked position to a downward, locked position.

BRIEF DESCRIPTION OF THE DRAWINGS

Aspects and features of the present disclosure are described herein with reference to the accompanying drawings, wherein.

DETAILED DESCRIPTION

Figure 1A:
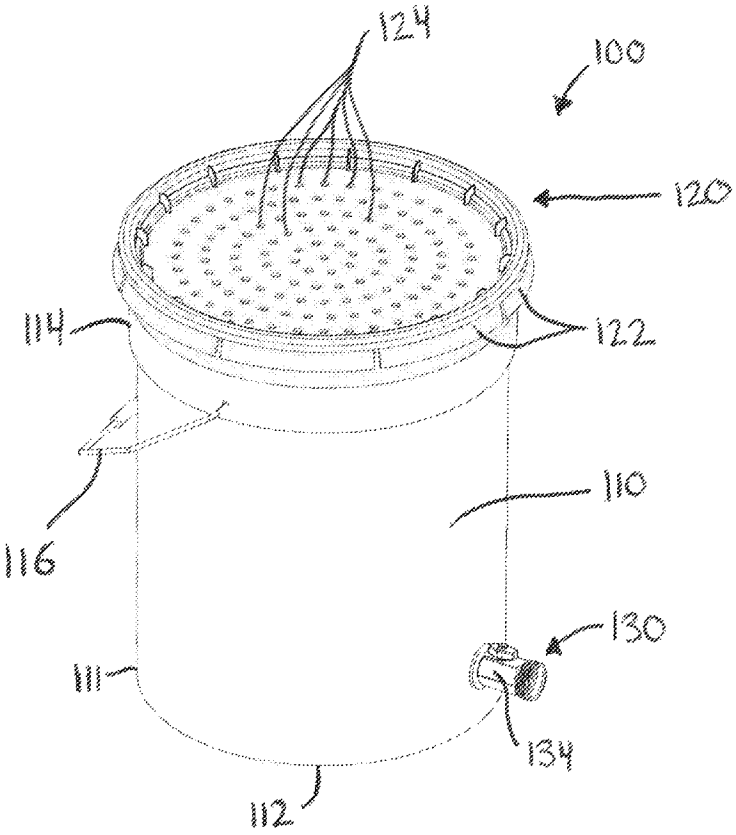
FIG. 1A is a perspective view of an article washing apparatus provided in accordance with aspects of the present disclosure.

Various embodiments of the present disclosure will now be described in detail with reference to the drawings, wherein like reference numerals identify similar or identical elements. In the following description, well known functions or constructions are not described in detail to avoid obscuring the present disclosure. To the extent consistent, any of the aspects and/or features of any of the embodiments detailed herein may be used in conjunction with any of the aspects and/or features of any of the other embodiments detailed herein.

Turning to FIGS. 1A-2B, an article washing system provided in accordance with the present disclosure is shown generally identified by reference numeral 10. Article washing system 10 includes an article washing apparatus 100 (FIG. 1A), an input hose 200 releasably connectable with and configured to supply water or other fluid to article washing apparatus 100, and, optionally, an output hose 300 releasably connectable with and configured to remove water or other fluid expelled from article washing apparatus 100. Article washing apparatus 100 generally includes a bucket 110, a lid 120, an input connector 130, a filter member 140, and, optionally, a collection hood 150 (FIG. 1B; not shown in FIG. 1A).

Bucket 110 may be a standard 5-gallon bucket, or may define any other suitable size, shape, and/or configuration, depending, for example, upon the particular items configured for use therewith, e.g., wetsuits, bathing suits, beach towels, clothing, footwear, snorkels, masks, diving/scuba gear, etc. Bucket defines a lower end 111 enclosed via a base 112, an internal chamber 113, and an open upper end 114. A handle 116 may be provided to facilitate manipulation and transport of bucket 110. Bucket 110 further defines an input opening 118 defined through a sidewall thereof towards lower end 111 thereof.

Figure 3:
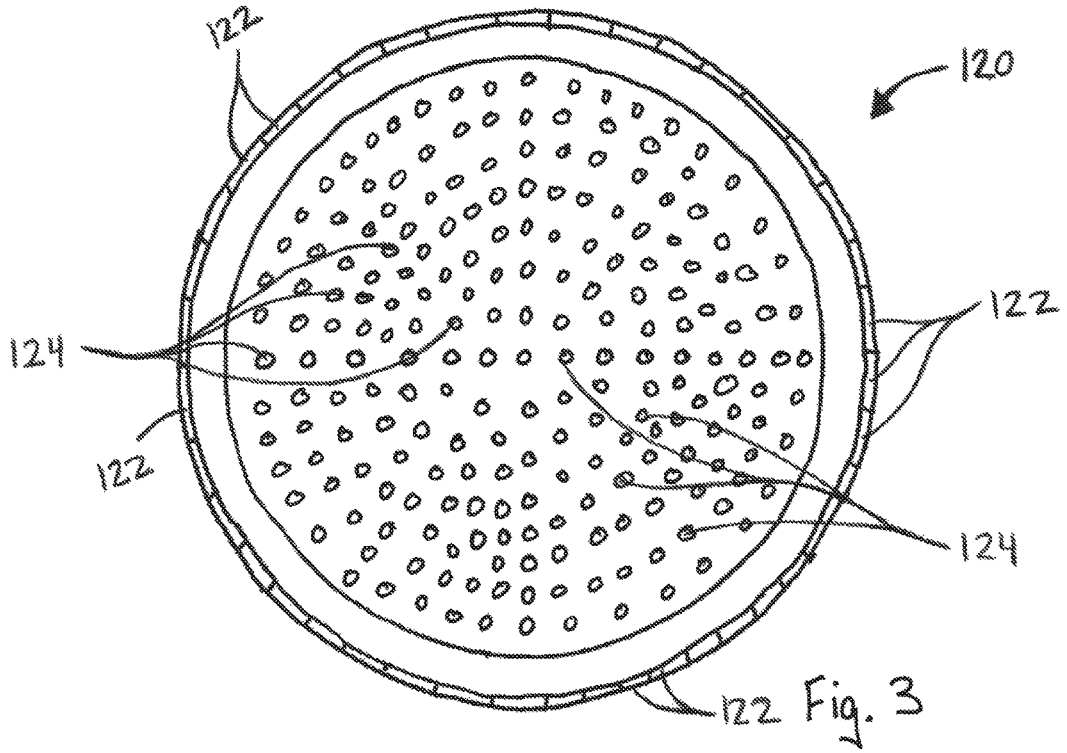
FIG. 3 is a top view of the lid of the article washing apparatus of FIG. 1A.

With additional reference to FIG. 3, lid 120 is configured to releasably sealingly engage the open upper end 114 of bucket 110. More specifically, lid 120 may include a plurality of snap fingers 122 disposed circumferentially about the perimeter thereof and configured to snap-fittingly engage the open upper end 114 of bucket 110 in sealing relation therewith, although other releasable sealing engagement configurations are also contemplated. Lid 120 defines a plurality of apertures 124 therethrough. Apertures 124 may be arranged in any suitable pattern and/or configuration. Specifically, apertures 124 may be configured, in connection with the inflow pressure of fluid into bucket 110, to achieve a desired pressure of fluid flow through bucket 110, as detailed below. Further, different lids 120 or a lid 120 with adjustable apertures 124 may be provided to achieve different pressures.

Referring again to FIGS. 1A-2B, input connector 130 is sealingly engaged within input opening 118 of bucket 110. Input connector 130 includes a valve 134 having a knob 135 to enable opening and closing of valve 134. Input connector 130 may be configured as a ball gate valve, or any other suitable valve. Input connector 130 further includes an exit tube 136 extending into internal chamber 113 of bucket 110 and an entry tube 138 disposed externally of bucket 110 and on an opposite side of valve 134 as compared to exit tube 136. Entry tube 138 defines threading 139 or other suitable engagement features for releasably securing an inflow device, e.g., input hose 200, therewith. As can be appreciated, with input hose 200 connected to input connector 130 and with valve 134 disposed in an open position, fluid can be supplied to internal chamber 113 of bucket 110 via input hose 200.

Figure 4:
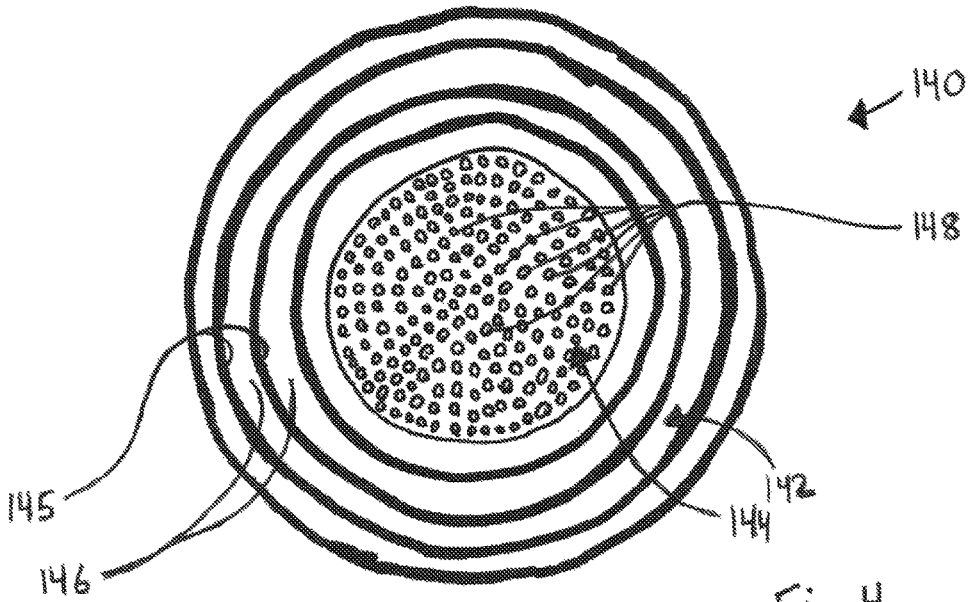
FIG. 4 is a top view of the filter member of the article washing apparatus of FIG. 1A.

With additional reference to FIG. 4, filter member 140 is configured for positioning within internal chamber 113 of bucket 110 adjacent base 112 and below exit tube 136 of input connector 132. Filter member 140 may be formed from a flexible material, e.g., rubber, and defines a generally disc-shaped configuration having an outer ring portion 142 and an inner circle portion 144. Filter member 140 further defines a diameter that generally approximates the diameter of internal chamber 113 of bucket 110. Outer ring portion 142 includes a plurality of concentric, spaced-apart annular ribs 145 disposed about inner circular portion 144 so as to define a plurality of annular grooves 146 between the ribs 145. Inner circle portion 144 defines a plurality of apertures 148 therethrough. Apertures 148 may be arranged in any suitable pattern and/or configuration. In some embodiments, filter member 140 is a collapsible colander disposed in a collapsed condition and defining the above-detailed features.

Referring back to FIGS. 1B-2B, as noted above, collection hood 150 is optional in that collection hood 150 may be provided for use in some embodiments, while in other embodiments, collection hood 150 is not provided. Collection hood 150 includes a body 152 defining an interior area 153 and an open mouth 154. Body 152 may be formed from a flexible material. Collection hood 150 further includes an engagement member 156, e.g., an elastic band, ratchet connector, lever latch, or other suitable engagement feature, disposed about body 152 towards open mouth 154 thereof. Engagement member 156 is configured to sealingly engage lid 120 and/or upper end 114 of bucket 110. Interior area 153 of body 152 of collection hood 150 is configured to collect the fluid expelled through apertures 124 of lid 120. Collection hood 150 may further include an outlet 158 configured to enable the outflow of fluid from within interior area 153 of body 152 of collection hood 150. Outlet 158 may be configured to releasably engage an outflow device, e.g., output hose 300.

Figure 1B:
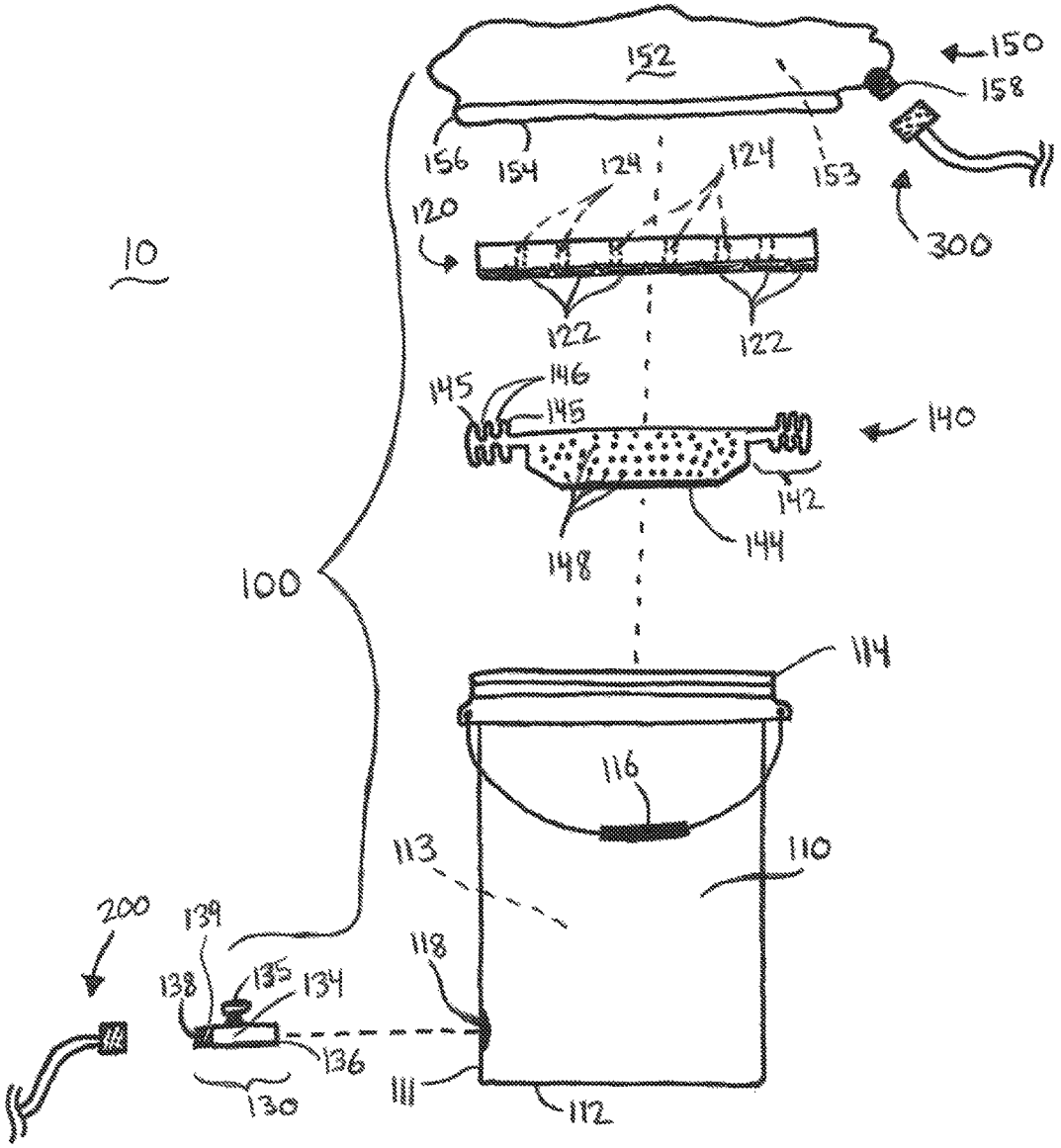
FIG. 1B is an exploded, side view of an article washing system including the article washing apparatus of FIG. 1A.
Figure 2A:
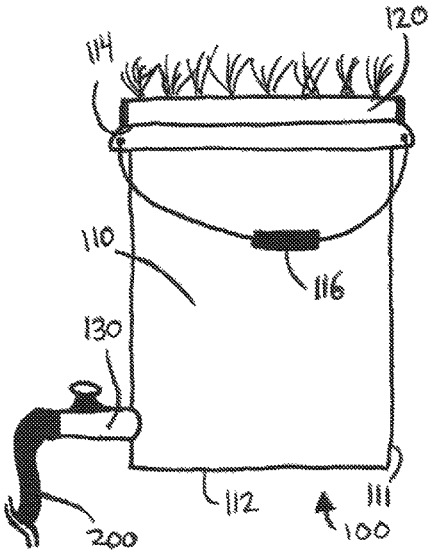
FIG. 2A is a side view of one configuration of the article washing system of FIG. 1B, shown in use.
Figure 2C:
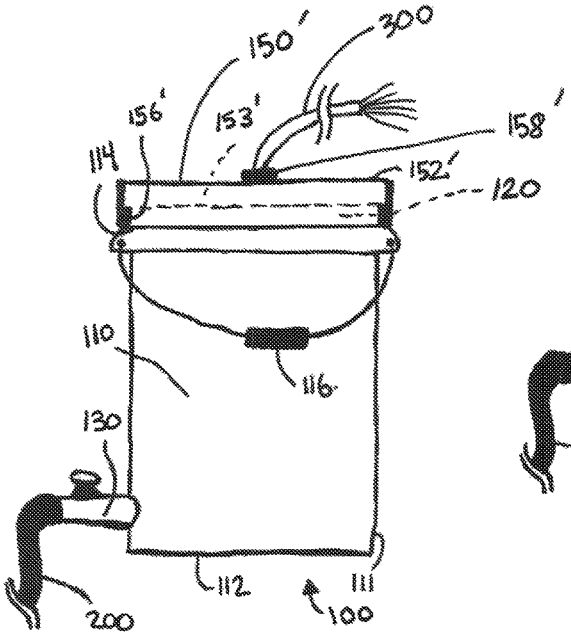
FIG. 2C is a side view of yet another configuration of the article washing system of FIG. 1B, shown in use.
Figure 2B:
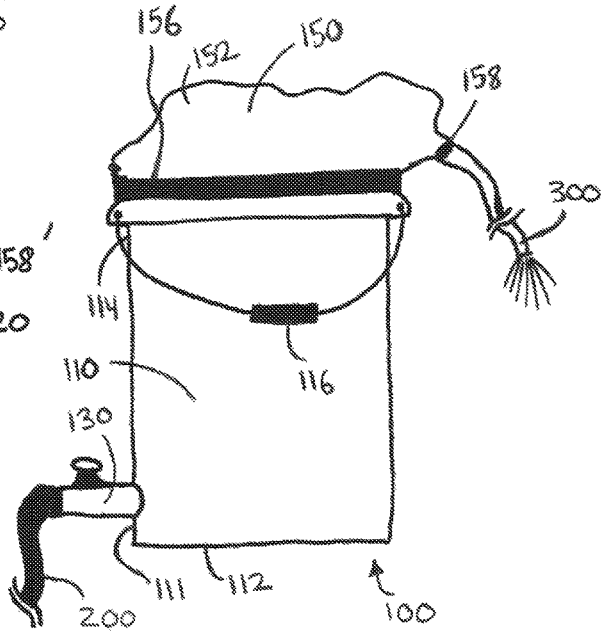
FIG. 2B is a side view of another configuration of the article washing system of FIG. 1B, shown in use.

Referring to FIG. 2C, in conjunction with FIG. 1B, article washing apparatus 100 is shown in use with another collection hood 150'. Collection hood 150' serves a similar purpose as collection hood 150 (FIG. 2B) and is likewise configured to sealingly engage lid 120 and/or upper end 114 of bucket 110. Collection hood 150' includes a rigid body 152' defining an interior area 153'. Collection hood 150' further includes an engagement member 156', e.g., a ratchet connector, lever latch, or other suitable engagement feature, disposed about body 152' and configured to sealingly engage collection hood 150' about lid 120 and/or upper end 114 of bucket 110. Interior area 153' of body 152' of collection hood 150' is configured to collect the fluid expelled through apertures 124 of lid 120. Collection hood 150' may further include an outlet 158' configured to enable the outflow of fluid from within interior area 153' of body 152' of collection hood 150'. Outlet 158' may be configured to releasably engage an outflow device, e.g., output hose 300.

Article washing apparatus 100 may further include support structures, shelving, platforms, or other suitable features (not shown) mounted within bucket 110 and/or removably positionable therein for supporting non-floating items. As can be appreciated, with respect to floating articles such as wetsuits, such features are not required.

Turning to FIGS. 1A-2B and 5, the method of use and operation of article washing system 10 is detailed. Initially, article washing system 10 is assembled and article washing apparatus 100 is coupled with input hose 200 and, if desired, output hose 300. Such assembly includes inserting filter member 140 into internal chamber 113 of bucket 110 (if not already positioned therein) and connecting input hose 200 with entry tube 138 of input connector 130. The other end of input hose 200 is connected to a pressurized fluid source, e.g., pressurized water from a spigot of a fresh-water plumbing system(not shown).

At this point, the article to be washed, e.g., a wetsuit 400, is placed within internal chamber 113 of bucket 110 atop filter member 140. Thereafter, lid 120 is sealingly engaged about upper end 114 of bucket 110. If a collection hood 150 is desired, engagement member 156 of collection hood 150 is sealingly engaged about lid 120 and/or upper end 114 of bucket 110. Output hose 300 may be coupled to outlet 158 of collection hood 150.

Figure 5:
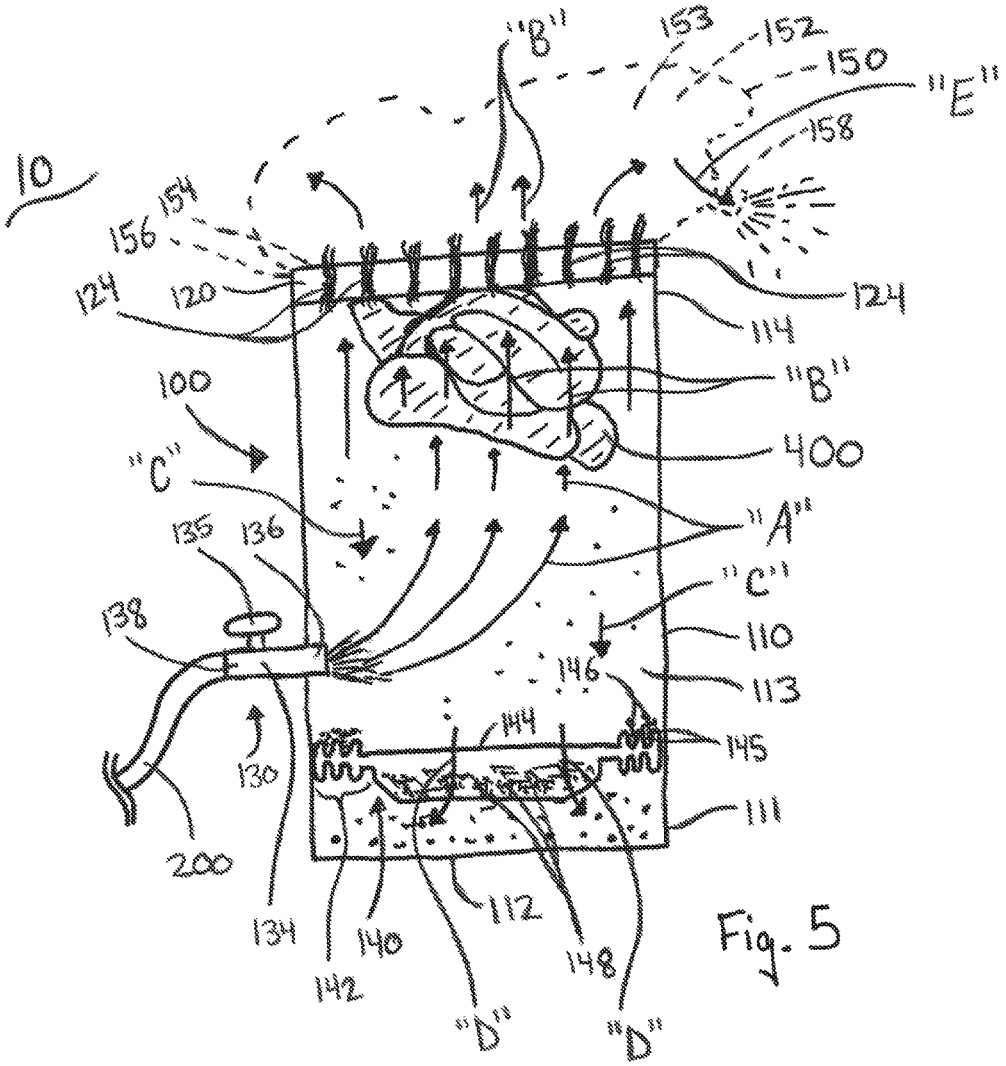
FIG. 5 is a side, cross-sectional view of the article washing system of FIG. 1B, shown in use.

Once assembled as detailed above, article washing system 10 is ready for use. With particular reference to FIG. 5, to initiate washing, the fluid supply is turned "ON" and, if not already done so, valve 134 is moved to an open position such that water is pumped through input hose 200, input connector 130, and into internal chamber 113 of bucket 110. As water is pumped into internal chamber 113 of bucket 110, internal chamber 113 is filled with water and, as a result of wetsuit 400 being buoyant and, thus, floating atop the water level, wetsuit 400 is moved upwardly towards lid 120 as water continues to fill internal chamber 113. Upon continued pumping of water into internal chamber 113, internal chamber 113 eventually becomes full. As apertures 124 provide the only escape path from internal chamber 113 of bucket 110, the pumping of additional water into internal chamber 113 urges the water within bucket 110 to flow against gravity in the direction of arrows "A." With water flowing in this manner, under the pressure of the fluid source (not shown), at least some of the water is urged through wetsuit 400, before exiting bucket 110 by way of apertures 124, as indicated by arrows "B." More specifically, due to the buoyancy of wetsuit 400 and the upward flow of water through bucket 110, wetsuit 400 is pinned against the interior surface of lid 120, blocking at least some of apertures 124. As a result, at least some of the water is forced through wetsuit 400 prior to escaping through apertures 124.

As water is pumped upwardly through bucket 110, the general presence of water surrounding wetsuit 400 as well as the flow of water through and around wetsuit 400 dislodges sand and debris caught on or within wetsuit 400. The sand and other debris fall, under gravity, towards the lower end 111 of bucket 110, as indicated by arrows "C." Eventually, the sand and debris are collected within annular grooves 146 of filter member 140 and/or pass through apertures 148 of filter member 140, as indicated by arrows "D," before settling at the base 112 of bucket 110.

In addition to the removal of sand and debris as detailed above, the urging of water through wetsuit 400 to be expelled via apertures 124 of lid 120 serves to purge the wetsuit 400 of salt absorbed therein or disposed thereon. In particular, it has been found that salinity of the wetsuit 400 can be reduced from 26 parts per thousand down to 0 parts per thousand due to the flow of pressurized fluid therethrough, as the fluid seeks to escape bucket 110 via apertures 124. The salt purged from wetsuit 400 is mixed with the water flowing upwardly through bucket 110 and, thus, is likewise expelled through apertures 124 of lid 120. Article washing system 10 is continuously operated, as detailed above, for a sufficient amount of time so as to fully desalinate wetsuit 400 and remove the sand and debris therefrom, or may be operated to a point of sufficiently low salination and/or cleanliness.

The water pressure within bucket 110 and the water flow pressure through bucket 110 depends at least in part on the pressure of the fluid source (not shown) and the configuration of apertures 124. As such, the inflow pressure of water from the fluid source may be varied (or the extent to which inflow is permitted may be varied, by adjusting input connector 130) and/or different lids 120 may be utilized (or the apertures 124 of lid 120 may be adjusted, in embodiments where a lid 120 with adjustable apertures 124 is provided) to achieve an appropriate pressure. The appropriate pressure may depend upon the size of the bucket 110; the size, configuration, material make-up, and/or type of article disposed within bucket 110; the extent to which the article is soiled by sand, debris, and salt; the desired washing time; and/or other factors.

Continuing with reference to FIG. 5, as noted above, water is urged through wetsuit 400 and out of bucket 110 by way of apertures 124 of lid 124, as indicated by arrows "B." In embodiments where collection hood 150 is not provided (see also FIG. 2A), the expelled water is simply permitted to flow over the exterior of lid 120 and bucket 110, under gravity. However, in embodiments where collection hood 150 is provided (see also FIG. 2B), the water exiting bucket 110 flows into interior area 153 of collection hood 150 and, ultimately, out through outlet 158 of collection hood 150, as indicated by arrow "E." As can be appreciated, collection hood 150 contains the water expelled from bucket 110, thus allowing the water to be channeled through outlet 158 in a particular direction or through outlet 158 and into output hose 300 (FIG. 2B) for depositing the water at a location displaced from bucket 110.

Referring generally to FIGS. 6A-9B, various other embodiments of article washing apparatus 600 (FIGS. 6A and 6B), 700 (FIGS. 7A and 7B), 800 (FIGS. 8A and 8B), 900 (FIGS. 9A and 9B) are illustrated and detailed below. Any of the article washing apparatus 100 (FIG. 1A), 600, 700, 800, 900 detailed herein may include any or all of the features of any of the other article washing apparatus 100 (FIG. 1A), 600, 700, 800, 900 detailed herein. Further, article washing apparatus 100 (FIG. 1A), 600, 700, 800, 900 may be used as part of an article washing system, e.g., article washing system 10 (FIG. 1B) or any other suitable article washing system. For the purposes of brevity, only differences between article washing apparatus 600, 700, 800, 900 and article washing apparatus 100 (FIG. 1A) will be described in detail below, while similarities will be summarily described or omitted entirely. The use and operation of article washing apparatus 600, 700, 800, 900 are also similar to that of article washing apparatus 100 (FIG. 1A), detailed above, and thus, will not be repeated hereinbelow.

Figure 6A:
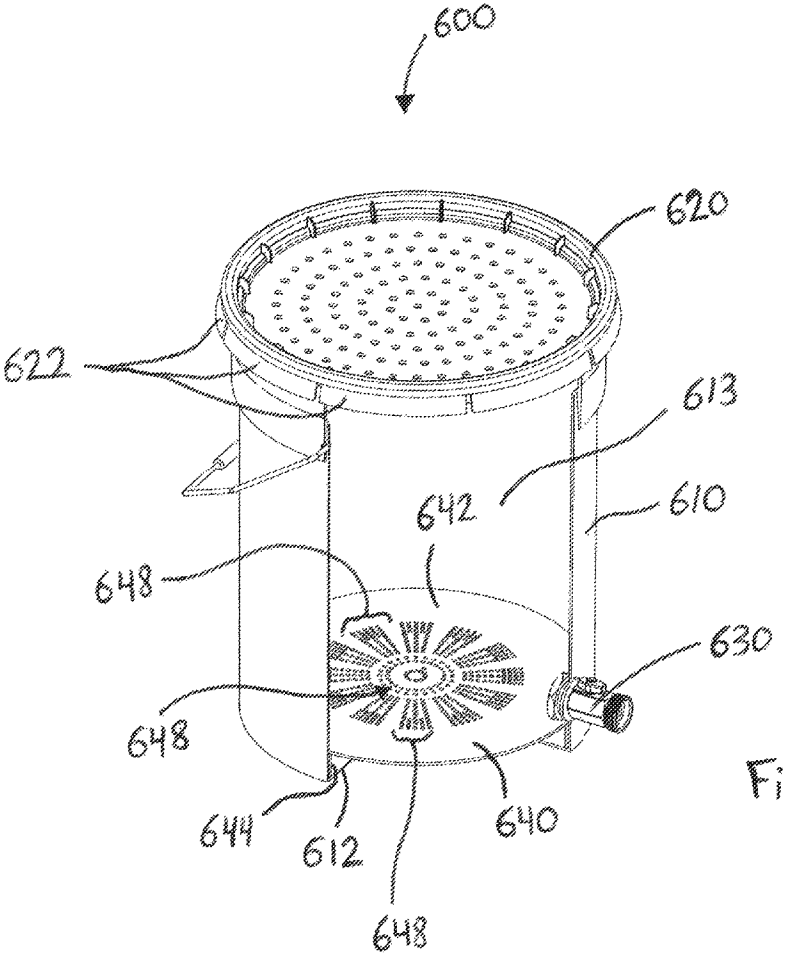
FIG. 6A is a perspective, cut-away view of another article washing apparatus provided in accordance with aspects of the present disclosure.
Figure 6B:
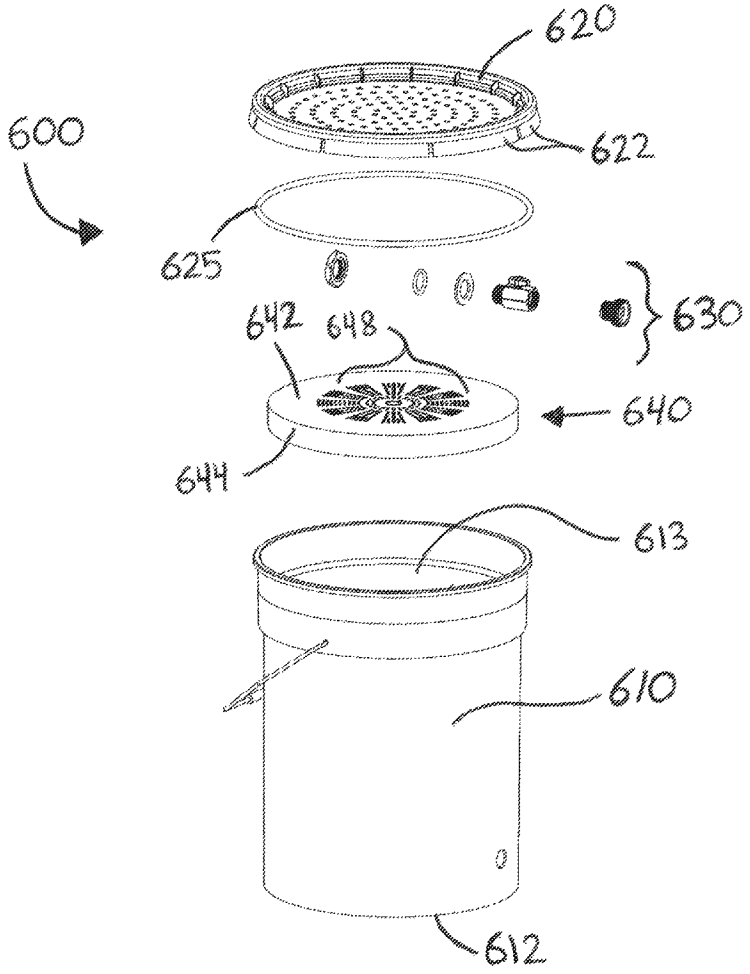
FIG. 6B is an exploded, perspective view of the article washing apparatus of FIG. 6A.

Turning to FIG. 6A-6B, article washing apparatus 600 generally includes a bucket 610, a lid 620, an input connector 630, and a filter member 640. An O-ring 625 is configured to fit within a groove (not shown) on an underside of lid 620 and radially inwardly of snap fingers 622. O-ring 625 serves to facilitate formation of a fluid-tight seal between lid 620 and bucket 610 when lid 620 is engaged thereabout.

Filter member 640 of article washing apparatus 600 is configured for positioning within internal chamber 613 of bucket 610 adjacent base 612 and below input connector 630. Filter member 640 may be formed from a flexible material, e.g., rubber, and defines a generally disc-shaped body 642 and an annular flange 644. Annular flange 644 is configured to sit atop base 612 of bucket 610 such that disc-shaped body 642 is spaced-apart from base 612 of bucket 610. Disc-shaped body 642 may be planar in configuration or, due to the flexible nature thereof, may sag slightly in the middle. Disc-shaped body 642 defines a plurality of apertures 648 therethrough. Apertures 648 may be of similar size or different sizes, and may be arranged in any suitable pattern (symmetric or asymmetric). In use, similarly as detailed above, the sand and other debris are configured to pass through apertures 648 of filter member 640 and settle at the base 612 of bucket 610. In embodiments where disc-shaped body 642 sags in the middle (and in embodiments where disc-shaped body 642 is urged to flex from its planar, at-rest condition towards a sagging condition), sand and other debris are funneled towards a center of disc-shaped body 642. In such a configuration, apertures 648 may be arranged, e.g., in a radially symmetric manner, so as to facilitate the passage of sand and other debris therethrough during this radially-inward funneling of the sand and other debris. However, other configurations are also contemplated.

Figure 7A:
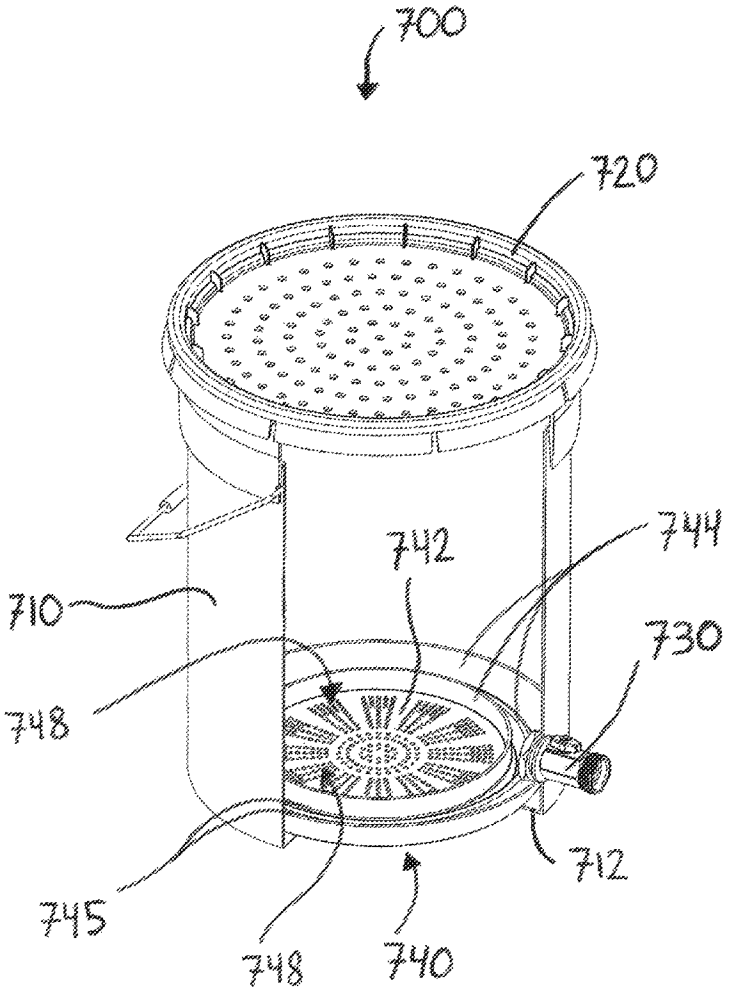
FIG. 7A is a perspective, cut-away view of another article washing apparatus provided in accordance with aspects of the present disclosure.
Figure 7B:
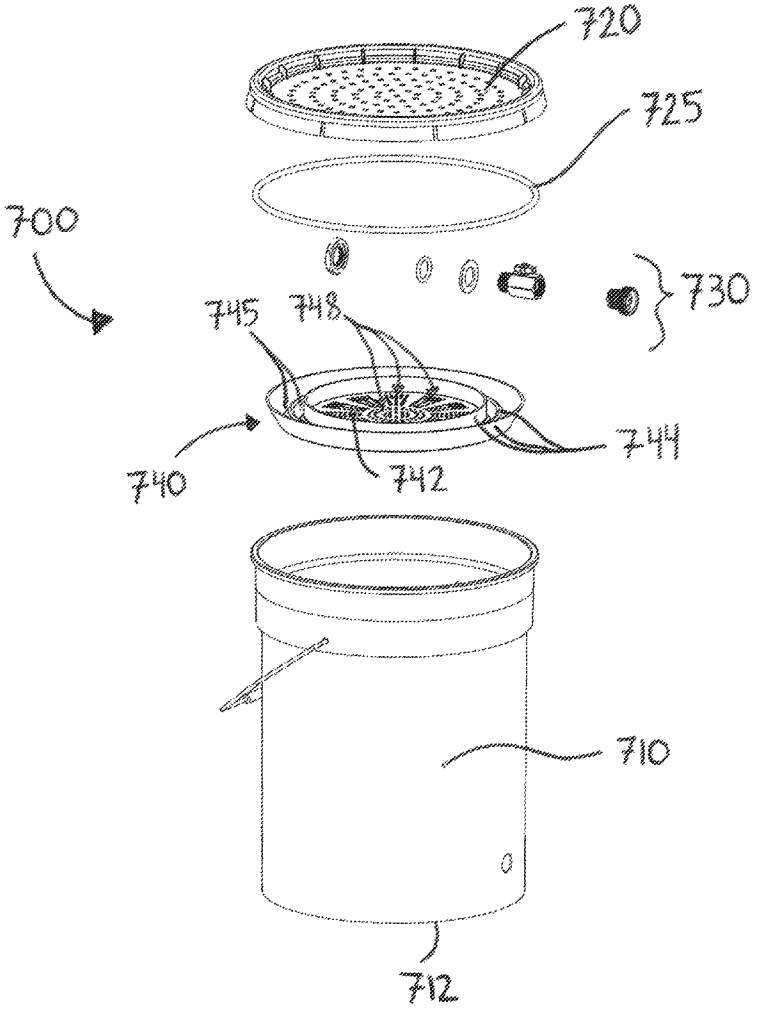
FIG. 7B is an exploded, perspective view of the article washing apparatus of FIG. 7A.

With reference to FIGS. 7A-7B, article washing apparatus 700 generally includes a bucket 710, a lid 720, an O-ring 725, an input connector 730, and a filter member 740. Filter member 740 of article washing apparatus 700 may be formed from a flexible material, e.g., rubber, and defines a generally disc-shaped configuration having a disc-shaped body 742 and a plurality of spaced-apart rims 744 disposed annularly about disc-shaped body 742. One or more of rims 744 extends below disc-shaped body 742 such that disc-shaped body 742 is spaced-apart from base 712 of bucket 710. An annular groove 745 is defined between each pair of adjacent rims 744. Disc-shaped body 742 includes a plurality of apertures 748 defined therethrough and may be configured similarly to disc-shaped body 642 of filter member 640 of article washing apparatus 600 (FIGS. 6A and 6B). Rims 744 and grooves 745, similarly as with ribs 145 and grooves 146 of filter member 140 of article washing apparatus 100 (FIG. 1B), serve to collect some sand and debris, while other sand and debris is passed through apertures 748 and ultimately settle at the base 712 of bucket 710. The outer-most rim 744 may be angled outwardly to meet the sidewall of bucket 710, while the inner rims 744 are oriented generally perpendicularly relative to disc-shaped body 742. Further, rims 744 may define different heights, e.g., with the outer-most rim 744 defining a first height, the inner-most rim 744 defining a second height equal to or shorter than the first height, and the intermediate rim 744 defining a third height shorter than the second height, although different configurations and/or numbers of rims 744 may also be provided.

Figure 8A:
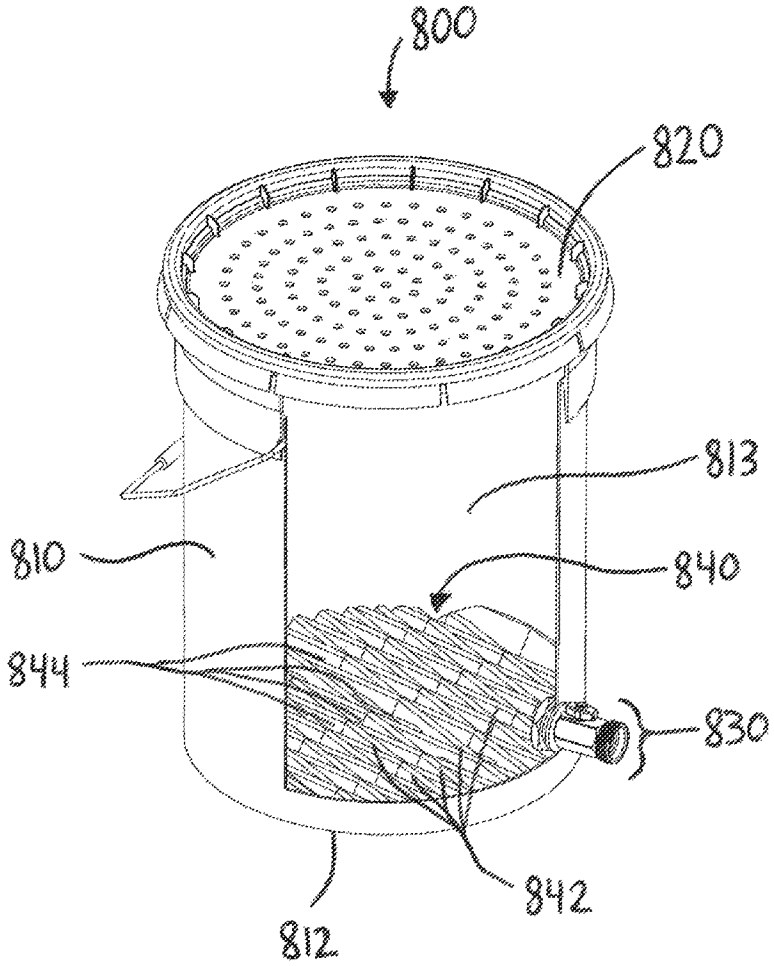
FIG. 8A is a perspective, cut-away view of another article washing apparatus provided in accordance with aspects of the present disclosure.
Figure 8B:
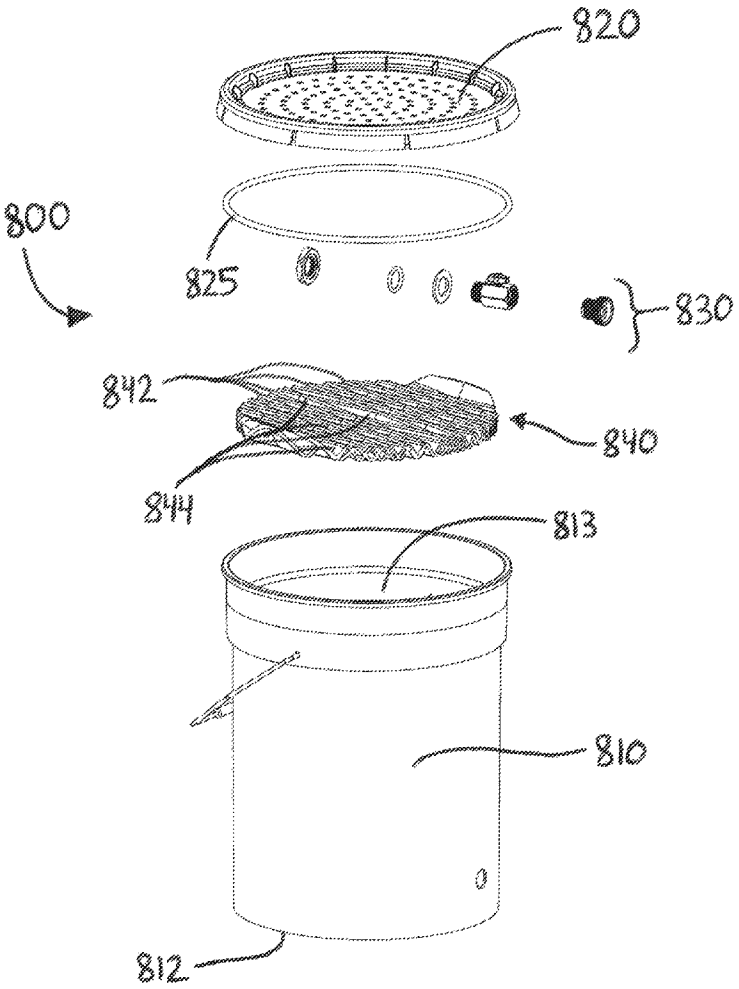
FIG. 8B is an exploded, perspective view of the article washing apparatus of FIG. 8A.

Referring to FIGS. 8A-8B, article washing apparatus 800 generally includes a bucket 810, a lid 820, an O-ring 825, an input connector 830, and a filter member 840. Filter member 840 of article washing apparatus 800 may be formed from a flexible material, e.g., rubber, and is configured to sit atop base 812 of bucket 810 within internal chamber 813 thereof. Filter member 840 defines a matrix of ridges 842 and recesses 844. Ridges 842 and recesses 844 are arranged to define diamond-shaped configurations, although other configurations are also contemplated. Recesses 844 are configured to collect sand and debris that fall, through gravity, towards base 812 of bucket 810 during use, similarly as detailed above.

Figure 9A:
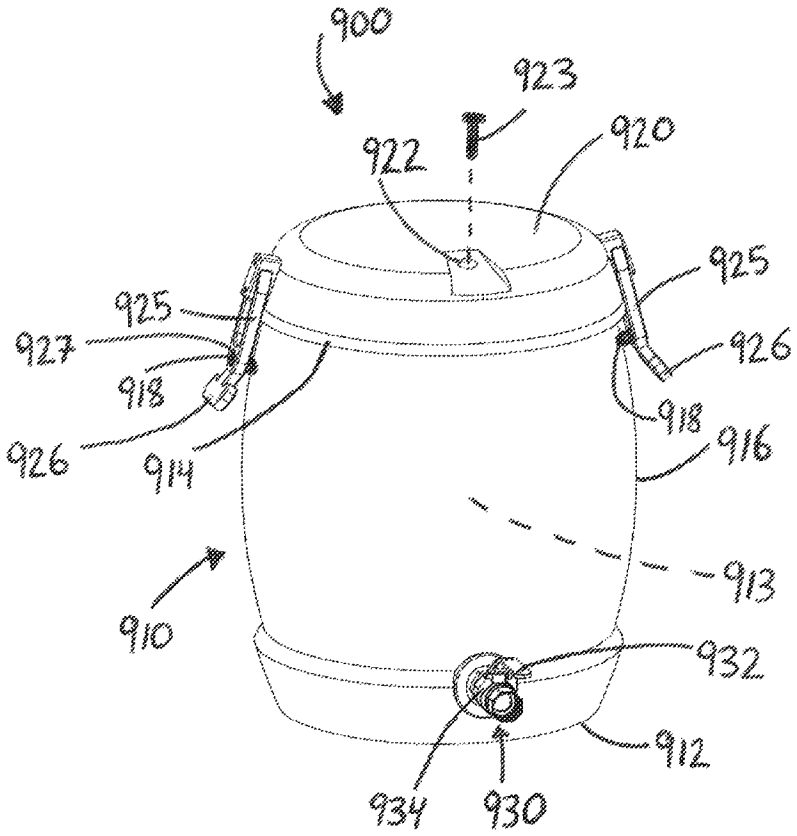
FIG. 9A is a perspective view of another article washing apparatus provided in accordance with aspects of the present disclosure.
Figure 9B:
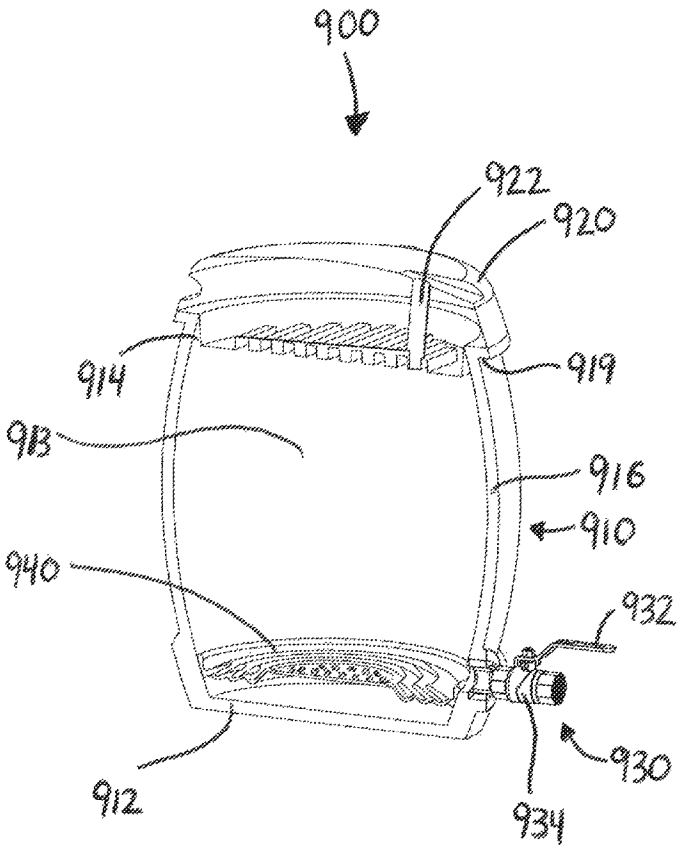
FIG. 9B is a perspective, cross-sectional view of the article washing apparatus of FIG. 9A.

Turning now to FIGS. 9A and 9B, article washing apparatus 900 generally includes a barrel 910, a lid 920, a pair of lock handles 925, an input connector 930, and a filter member 940. Barrel 910 includes a base 912, an open upper end 914 and a body 916 that extends between and bows outwardly relative to open upper end 914 and base 912. Barrel 910 further includes a pair of diametrically-opposed chucks 918 disposed on the exterior thereof towards upper end 914 thereof. Chucks 918, as detailed below, are configured to receive lock handles 925 thereabout, e.g., in compression-fit thereabout, to secure lid 920 about open upper end 914 of barrel 910 in fluid-tight engagement therewith, although other suitable locking mechanisms are also contemplated.

Lid 920 of article washing apparatus 900 defines an exit port 922 extending therethrough. Exit port 922 fluidly communicates with the internal chamber 913 of barrel 910 with lid 920 engaged about barrel 910 so as to enable the escape of fluid from internal chamber 913 of barrel 910, e.g., similarly as detailed above with respect to apertures 124 of lid 120 of article washing apparatus 100 (FIG. 1A). A stopper 923 may be provided to plug exit port 922 of lid 920 during transport or when article washing apparatus 900 is otherwise not in use. Further, rather than using a collection hood 150 as with system 10 (see FIG. 1B), output hose 300 (FIG. 1B) may be directly coupled to exit port 922 to receive the fluid expelled from barrel 910. Alternatively, fluid (and salt) may simply flow from exit port 922 out and about barrel 910.

Lock handles 925 are pivotably coupled to lid 920 at diametrically-opposed positions and each define a grasping portion 926 and an aperture 927. Grasping portions 926 are disposed towards the free ends of lock handles 925, opposite the pivotably coupled ends thereof and are configured to facilitate manual manipulation of lock handles 925 between an upward, unlocked position, and a downward, locked position. Apertures 927 are shaped complementary to and configured to receive chucks 918 of barrel 910 in the downward, locked position such that lock handles 925 are maintained in the downward, locked position. In this downward, locked position, lid 920 is held in compression against open upper end 914 of barrel 910 to maintain a fluid-tight seal thereabout. As an alternative to providing chucks 918 and apertures 927, lock handles 925 may be configured to engage annular lip 919 (FIG. 9B) of barrel 910 to engage lid 920 about barrel 910 in fluid-tight fashion.

Input connector 930 is similar to input connector 130 of article washing apparatus 100 (FIG. 1A) except that input connector 930 includes a cantilever arm 932 operably engaged to the valve mechanism of input connector 930 at a fixed end thereof and defining a second, free end. The second, free end of cantilever arm 932 is rotatable relative to a body 934 of input connector 930 between an open position, corresponding to an open condition of the valve mechanism, and a closed position, corresponding to a closed condition of the valve mechanism, to permit or inhibit the supply of fluid into barrel 910.

Filter member 940 may be configured similar to any of the filter members detailed hereinabove, or may define any other suitable configuration.

It will be understood that various modifications may be made to the embodiments of the present disclosure. Therefore, the above description should not be construed as limiting, but merely as exemplifications of embodiments. Those skilled in the art will envision other modifications within the scope and spirit of the present disclosure.

What is claimed is:

1. An apparatus for washing an article, comprising:

a container including a sidewall and a base cooperating to define an internal chamber configured to receive an article to be washed, the base of the container defining a closed lower end of the container, the container having an open upper end, the container defining an inflow opening through the sidewall thereof towards the closed lower end thereof;

an inflow connector sealingly engaged within the inflow opening of the sidewall of the container, the inflow connector configured to connect to a source of pressurized fluid for supplying pressurized fluid to the internal chamber of the container;

a filter member disposed within the internal chamber of the container between the base of the container and the inflow opening of the container, the filter member configured to at least one of: collect particulate or permit passage of particulate therethrough; and a lid releasably sealingly engagable with the upper end of the container, the lid defining at least one opening therethrough, wherein the apparatus is configured such that pressurized fluid supplied through the inflow connector and into the internal chamber of the container is urged upwardly through the internal chamber of the container, through and around an article disposed within the internal chamber of the container, and out the at least one opening of the lid, thereby carrying or urging salt retained within or on the article through the apertures of the lid, and such that particulate on or within the article is at least one of: collected within the filter member or passed through the filter member to settle on the base of the container.

2. The apparatus according to claim 1, wherein the inflow connector includes a valve mechanism transitionable between an open configuration, permitting the inflow of fluid into the internal chamber of the container, and a closed configuration, inhibiting the inflow of fluid into the internal chamber of the container.

3. The apparatus according to claim 1, wherein the lid includes a plurality of snap-fingers configured for circumferential engagement about the open upper end of the container to releasably sealingly engage the lid about the upper end of the container.

4. The apparatus according to claim 1, wherein the lid includes at least one lock handle movable between an upward, unlocked position and a downward, locked position, to releasably sealingly engage the lid about the upper end of the container.

5. The apparatus according to claim 1, wherein the container is a bucket or a barrel.

6. The apparatus according to claim 1, wherein the filter member is formed from a flexible material and defines at least one groove configured to collect particulate and a plurality of apertures configured to permit passage of particulate therethrough.

7. The apparatus according to claim 1, wherein the filter member is formed from a flexible material and defines a plurality of ridges and recesses, the recesses configured to collect particulate.

8. The apparatus according to claim 1, wherein the filter member is formed from a flexible material and includes a body defining a plurality of apertures configured to permit passage of particulate therethrough and an annular flange configured to support the body spaced-apart above the base of the container.

9. A system for washing an article, comprising:

an inflow hose configured to connect to a source of pressurized fluid; and an article washing apparatus, including:

a container including a sidewall and a base cooperating to define an internal chamber configured to receive an article to be washed, the base of the container defining a closed lower end of the container, the container having an open upper end, the container defining an inflow opening through the sidewall thereof towards the closed lower end thereof;

an inflow connector sealingly engaged within the inflow opening of the sidewall of the container, the inflow connector configured to connect to the inflow hose for supplying pressurized fluid to the internal chamber of the container;

a filter member disposed within the internal chamber of the container between the base of the container and the inflow opening of the container, the filter member configured to at least one of: collect particulate or permit passage of particulate therethrough; and a lid releasably sealingly engagable with the upper end of the container, the lid defining at least one opening therethrough, wherein the apparatus is configured such that pressurized fluid supplied from the inflow hose through the inflow connector and into the internal chamber of the container is urged upwardly through the internal chamber of the container, through and around an article disposed therein, and out the at least one opening of the lid, thereby carrying or urging salt retained within or on the article through the at least one opening of the lid, and such that particulate on or within the article is at least one of: collected within the filter member or passed through the filter member to settle on the base of the container.

10. The system according to claim 9, further comprising an outflow hose configured to receive expelled fluid and salt from the apparatus.

11. The system according to claim 9, wherein the inflow connector includes a valve mechanism transitionable between an open configuration, permitting the inflow of fluid from the inflow hose into the internal chamber of the container, and a closed configuration, inhibiting the inflow of fluid from the inflow hose into the internal chamber of the container.

12. The system according to claim 9, wherein the lid includes a plurality of snap-fingers configured for circumferential engagement about the open upper end of the container to releasably sealingly engage the lid about the upper end of the container.

13. The system according to claim 9, wherein the lid includes at least one lock handle movable between an upward, unlocked position and a downward, locked position, to releasably sealingly engage the lid about the upper end of the container.

14. The system according to claim 9, wherein the filter member is formed from a flexible material and defines at least one groove configured to collect particulate and a plurality of apertures configured to permit passage of particulate therethrough.

15. The system according to claim 9, wherein the filter member is formed from a flexible material and defines a plurality of ridges and recesses, the recesses configured to collect particulate.

16. The system according to claim 9, wherein the filter member is formed from a flexible material and includes a body defining a plurality of apertures configured to permit passage of particulate therethrough and an annular flange configured to support the body spaced-apart above the base of the container.

* * * * *